US008656818B2

(12) United States Patent
Matthes et al.

(10) Patent No.: US 8,656,818 B2
(45) Date of Patent: Feb. 25, 2014

(54) DEVICE FOR THREE-SIDED TRIMMING OF PRODUCTS

(75) Inventors: Wolfgang Matthes, Kühren-Burkartshain (DE); Falk Wagner, Beucha (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 1355 days.

(21) Appl. No.: 11/485,655

(22) Filed: Jul. 13, 2006

(65) Prior Publication Data

US 2007/0028456 A1 Feb. 8, 2007

Related U.S. Application Data

(60) Provisional application No. 60/700,261, filed on Jul. 18, 2005.

(30) Foreign Application Priority Data

Jul. 19, 2005 (DE) ..... 10 2005 033 614

(51) Int. Cl.
*B26D 1/00* (2006.01)

(52) U.S. Cl.
USPC ..... 83/651; 83/72; 83/155.1

(58) Field of Classification Search
USPC ..... 83/651, 280, 282, 311–313, 321, 328, 83/72, 76.1, 934, 904, 155, 155.1
See application file for complete search history.

(56) References Cited

U.S. PATENT DOCUMENTS

| | | | | |
|---|---|---|---|---|
| RE28,840 | E | 6/1976 | Sarring | |
| 4,505,173 | A | 3/1985 | Hartlage | |
| 4,922,773 | A | 5/1990 | Ito | |
| 7,077,042 | B2 * | 7/2006 | Nogawa et al. | 83/466 |
| 2001/0037708 | A1 | 11/2001 | Matthes et al. | |
| 2002/0018701 | A1 | 2/2002 | Merkli | |
| 2002/0092394 | A1 * | 7/2002 | Rathert | 83/213 |
| 2003/0145703 | A1 * | 8/2003 | Rohe-Krebeck | 83/277 |
| 2004/0112195 | A1 * | 6/2004 | Lorenzi | 83/546 |

FOREIGN PATENT DOCUMENTS

| | | | |
|---|---|---|---|
| DE | 33 02 946 | A1 | 8/1983 |
| EP | 0 740 983 | A1 | 11/1996 |
| EP | 1 152 310 | A1 | 11/2001 |
| EP | 1 182 018 | A1 | 2/2002 |

* cited by examiner

*Primary Examiner* — Phong Nguyen
(74) *Attorney, Agent, or Firm* — Laurence A. Greenberg; Werner H. Stemer; Ralph E. Locher

(57) ABSTRACT

A device for three-sided trimming of products has a cutter lifting assembly that is operable in a lifting movement that determines a machine cycle of the device. Several cutters, at least for head trimming, foot trimming, and front edge trimming of the products, are mountable on the cutter lifting assembly. The device has a lateral alignment configuration, which is movable at least on one side, for performing a pushing movement against the product, by way of which the product can be brought into a cutting position. The device further includes a device for initiating and/or terminating the pushing movement of the alignment configuration in such a way that the time of initiation and/or the pushing duration of the pushing movement within the cycle duration of the device is independent of the lifting movement of the cutter lifting assembly.

7 Claims, 3 Drawing Sheets

DEVICE FOR THREE-SIDED TRIMMING OF PRODUCTS

CROSS-REFERENCE TO RELATED APPLICATIONS

This application claims the benefit, under 35 U.S.C. §119 (e), of provisional application No. 60/700,261, filed Jul. 18, 2005; the application also claims the benefit, under 35 U.S.C. §119(a), of German patent application No. 10 2005 033 614.0, filed Jul. 19, 2005; the earlier applications are herewith incorporated by reference in their entirety.

BACKGROUND OF THE INVENTION

Field of the Invention

The invention relates to a device for the three-sided trimming of products, in particular unbound books. The device has a cutter lifting assembly which is operable in a lifting movement. The lifting movement determines a machine cycle of the device. Cutters are provided for head trimming, foot trimming, and front edge trimming of the products. The cutters are mountable on the lifting assembly. The device further has a lateral alignment configuration, which is movable at least on one side, for performing a pushing movement against the product for bringing the product into a cutting position.

In the production of unbound books, book blocks and brochures, the products are assembled on gatherer-stitchers and cut in a device for three-sided trimming, for instance a trimmer. This is effected in the cutting stations for front cutting and head trimming or foot trimming by means of a moving upper cutter against a stationary lower cutter. In this connection, the trimming of the unbound book constitutes a particularly important step as by virtue of this the folded sheets are opened laterally and the outward appearance of the unbound book is influenced decisively. For this, it is important that the unbound books are cut positionally accurately. Before cutting, the product is therefore transported against front lays and aligned laterally in order to set the cutting width for head trimming or foot trimming exactly. It is known from the prior art that the mechanism for lateral alignment is in this connection driven by the lifting movement of the upper cutter carrier and is consequently linked directly to the movement sequence of the cutting movement. Such a trimmer is known. It is a disadvantage of the prior art that in such cutting systems the speed of the book block or brochure in the cutting system is limited as otherwise the rebound of the brochure or book block on the front lay prevents accurate alignment and thus accurate cutting.

SUMMARY OF THE INVENTION

It is accordingly an object of the invention to provide a device for the three-sided trimming of products which overcomes the above-mentioned disadvantages of the heretofore-known devices and methods of this general type and which provides for a cutting configuration that allows higher productivity.

With the foregoing and other objects in view there is provided, in accordance with the invention, a device for three-sided trimming of products, comprising:

- a cutter lifting assembly configured to be operable in a lifting movement defining a machine cycle with a cycle duration;

- a plurality of cutters, including cutters for head trimming, foot trimming, and front edge trimming of the products, mountable on said cutter lifting assembly;
- a lateral alignment configuration movable at least on one side, for performing a pushing movement against the product, for bringing the product into a cutting position;
- means for at least one of initiating and terminating the pushing movement of said alignment configuration to render at least one of a time of initiation of the pushing movement and a pushing duration of the pushing movement within the cycle duration substantially independent of the lifting movement of said cutter lifting assembly.

In other words the novel device for three-sided trimming comprises means for initiating and/or terminating the pushing movement of the alignment configuration in such a way that the time of initiation and/or the pushing duration of the pushing movement within the cycle duration of the device is independent of the lifting movement of the lifting assembly. By virtue of this separation of the cutting movement from the pushing movement, the time available overall for the three-sided trimming of the product can be better used. Moreover, adaptation of for example the pushing duration to different product characteristics such as its weight or dimensions is possible.

In accordance with an advantageous development of the inventive device, the alignment configuration is assigned a separate drive, the device advantageously comprising a control which activates the drive of the alignment configuration independently of the lifting movement of the lifting assembly. This dispenses with the complicated derivation of the pushing movement from the lifting movement of the lifting assembly, for instance by a mechanical cam gear. Moreover, product-dependently optimized electronic control curves can be stored in the control for the drive of the alignment configuration.

In an especially preferred embodiment of the device according to the invention, there is provided a transport system which brings the product into a first cutting position and from a first cutting position into a second cutting position within a transport period. As already mentioned, this transport period has a minimum which should not be fallen below as otherwise braking of the product in the cutting position is made more difficult by the correspondingly increased transport speed. Accordingly, the control of the alignment configuration is advantageously designed in such a way that it determines the time of initiation and/or termination of the pushing movement of the alignment configuration in such a way that the transport period is essentially not increased when a shortening of the cycle duration of the lifting movement of the lifting assembly takes place. In this connection, shifting the time of initiation and shortening the pushing movement duration within the machine cycle ensures, even in the case of increased productivity of the cutting configuration, that is a shortened cycle duration, that the transport of the product takes place with the same quality. In this way, it is possible to raise the machine rate from 10,000 cycles per hour to 14,000 or 16,000 cycles per hour, for example, while the transport period remains the same.

In a further advantageous embodiment of the device according to the invention, a front lay for the product is arranged at least intermittently in the region of at least one of the cutting positions of the device. The rest of the time, this front lay is advantageously pivoted out of the transport plane so as not to hinder the other movement sequences in the device.

In accordance with a concomitant feature of the invention, the pushing movement of the pushing arrangement takes place during the transport movement of the transport system. In particular, the transport system is advantageously operated in such a way that the product is already braked slightly before reaching the front lay and the transport system moves the product on toward the front lay with reduced speed during the lateral pushing movement.

Other features which are considered as characteristic for the invention are set forth in the appended claims.

Although the invention is illustrated and described herein as embodied in a device for the three-sided trimming of products, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
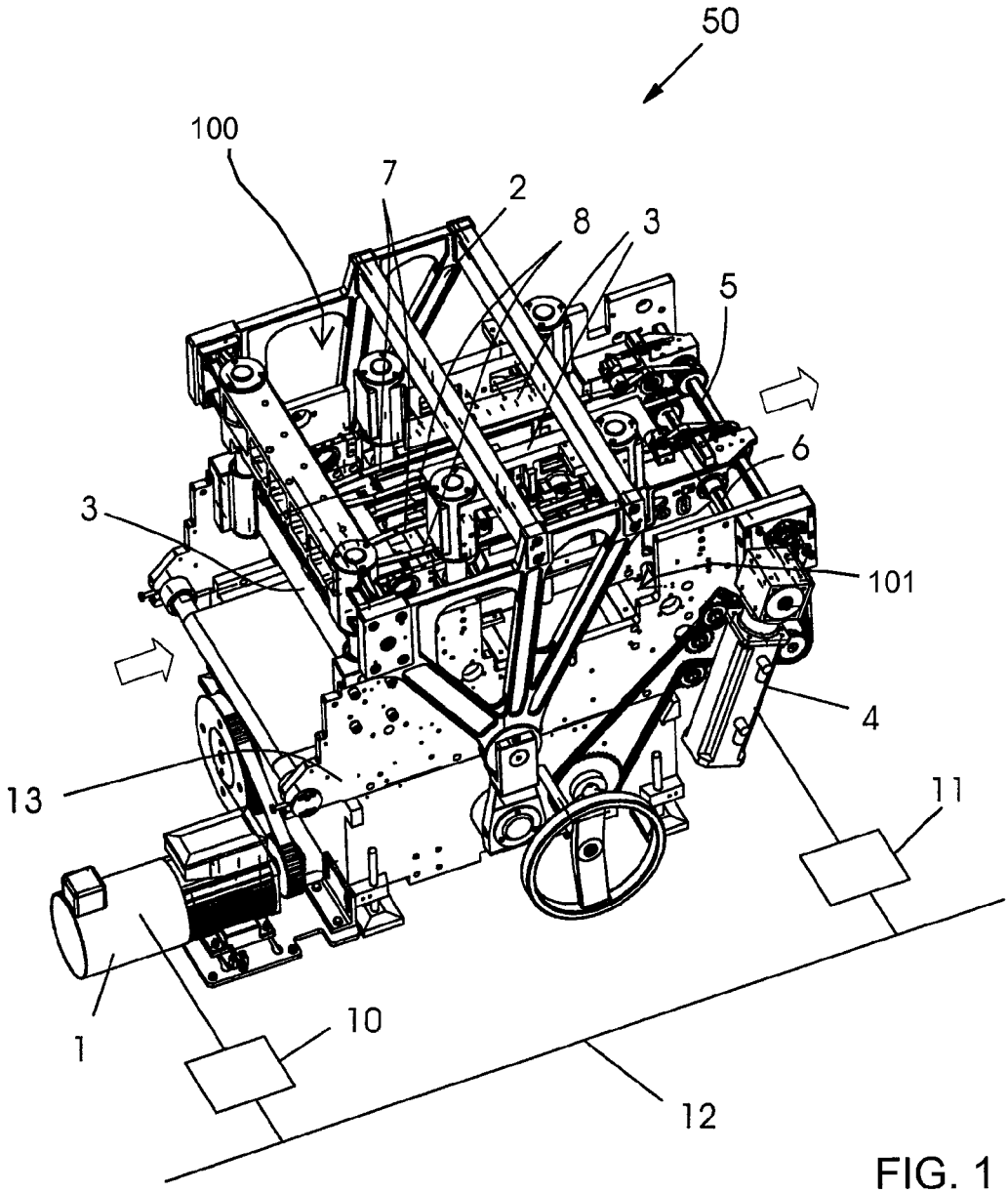
FIG. 1 is a diagrammatic perspective view of the cutting configuration for edge-trimming products.

Referring now to the figures of the drawing in detail and first, particularly, to FIG. 1, there is shown an exemplary embodiment of a cutting configuration for three-sided trimming of products. A first drive motor 1 effects the movement of a cutter lifting assembly 2, to which a plurality of cutters 3 are fastened. The product running direction is indicated by arrows. A second drive motor 4 drives belts 7, 8 of a transport system 9 via a first and a second drive shaft 5, 6. The transport system 9 transports the products in the product travel direction from a first cutting position 100 to a second cutting position 101. Control units 10, 11, which can communicate with one another by means of a connection for the exchange of data and/or control signals 12, are provided for both drive motors 1, 4. Furthermore, the connection 12 can also lead to a machine control unit and also to the control of the alignment configuration 42.

Figure 2:
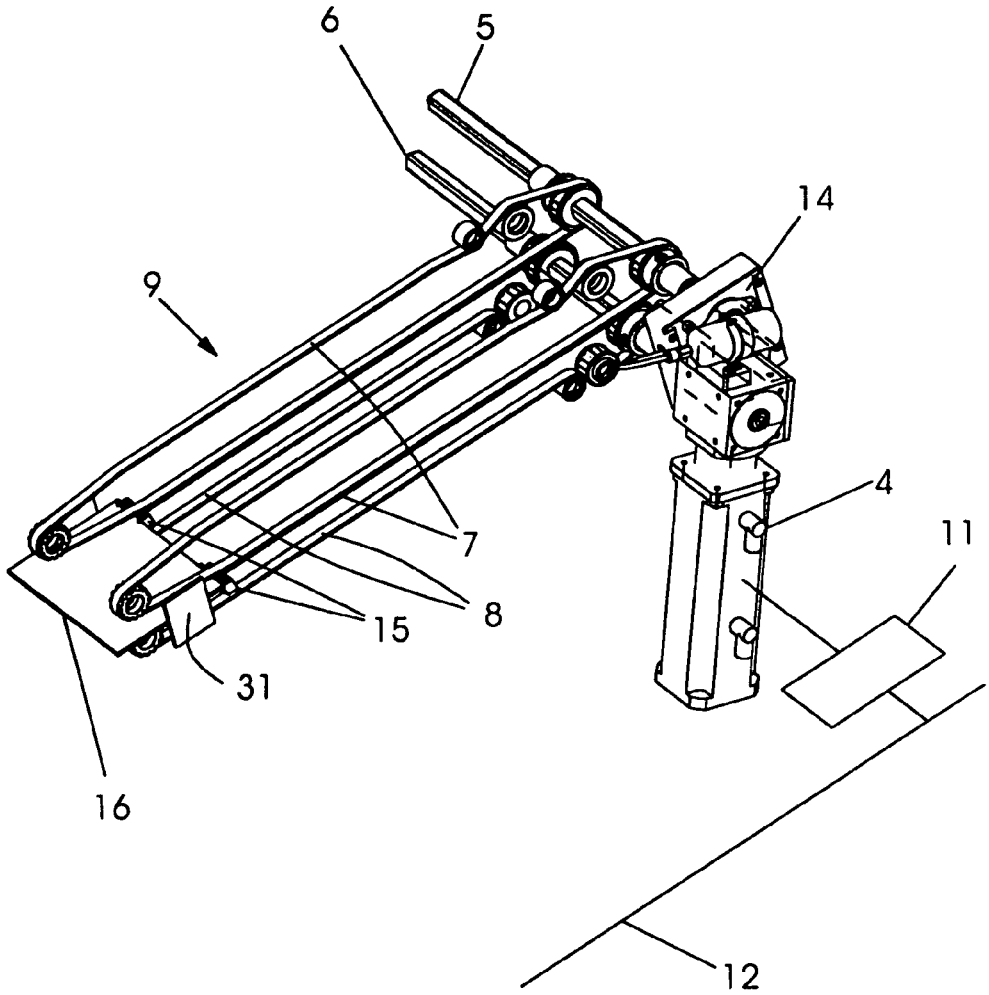
FIG. 2 is a perspective detail of the transport system of the cutting configuration.

The transport system of the apparatus is illustrated separately in FIG. 2. The drive motor 4 drives the drive shafts 5 and 6 and the belts 7, 8 of the transport system by means of a mechanical gear 14. Furthermore, the control unit 11 and the connection for the exchange of data and/or control signals 12 can be seen. The products, arriving from a non-illustrated, further transport system from the delivery of a stitching machine, are braked at the front edge stops 15, also referred to as front lays 15. By virtue of the electronic control by way of the control unit 11, it is possible to bring the product 16 up against the front lays 15 gently even at high speeds. The front lays 15 are typically provided only in a first cutting position for front edge trimming. Transport of the product 16 to the second cutting position by the transport system 9 takes place without further alignment.

Figure 3:
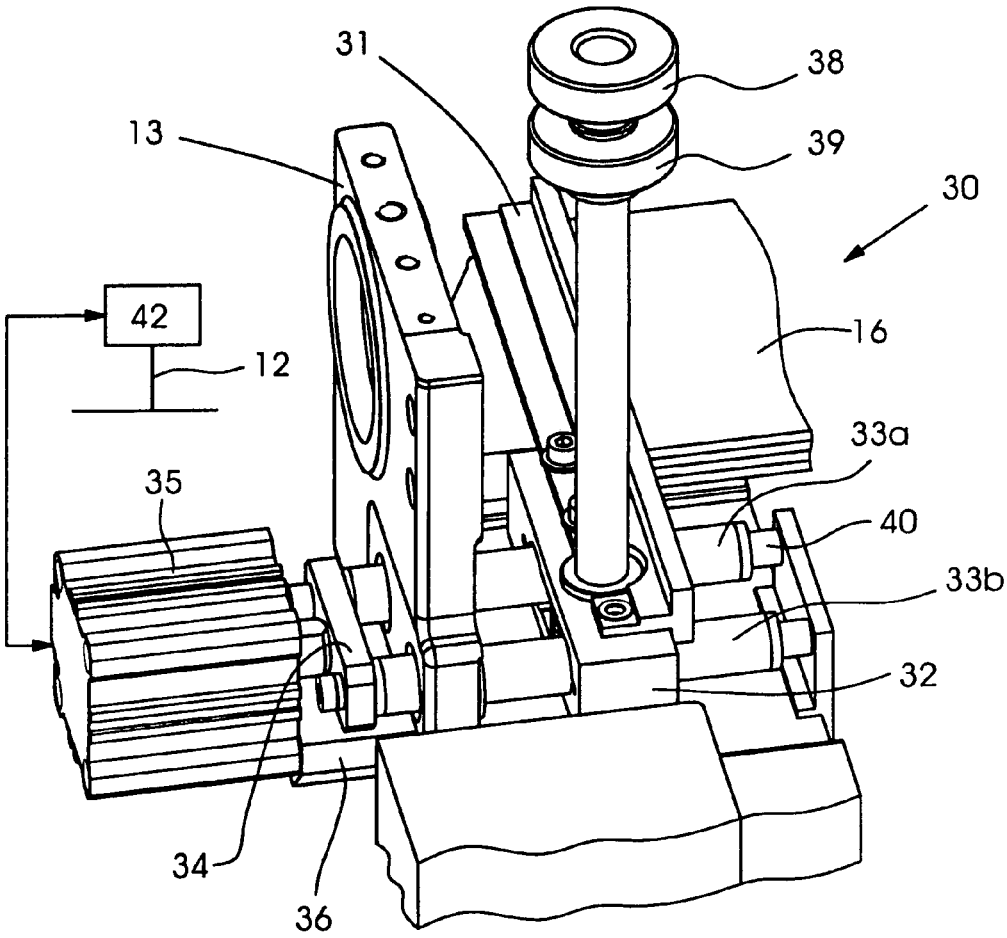
FIG. 3 is a partial perspective detail of the alignment configuration.

The alignment configuration 30 is illustrated in FIG. 3. Alignment of the product 16 is effected by the pushing strip 31 which contacts the product 16 laterally. Depending on the embodiment, an alignment configuration 30 according to the invention may be provided on only one side of the product 16. However, a preferred embodiment has an alignment configuration 30 on both sides of the product 16. These can be activated separately or together by a control 42. The pushing strip 31 is clamped firmly on guide pins 33*a*, 33*b* with a clamp 32. The guide pins 33*a*, 33*b* are at one end connected to a plate 34 to which the drive 35 for movement initiation is also connected. The drive 35 is fastened to the housing 13 of the cutting configuration 50 by a connecting piece 36. The drive 35 is activated via signals from the alignment control 42 and thus controlled independently of the movement of the cutter lifting assembly 2.

In order to align the product 16 laterally in the device 50, the pushing strip 31 is moved in a cyclically oscillating manner. By loosening the clamping screw 38, the clamping between the pushing strip 31 or the clamp 32 and the guide pins 33*a*, 33*b* is discontinued, and, by rotating the adjusting screw 39, the clamp 32 can be displaced on the guide pins 33*a*, 33*b* depending on the format. Different cutting widths are set in this way. In the illustrated embodiment of the alignment configuration 30, the drive 35 is a pneumatic cylinder. Other variants for imparting the pushing movement to the guide pins 33*a*, 33*b* are for instance lifting magnets or linear drives.

In continuous operation of the device 50 according to the invention, front edge trimming of a product 16 is carried out in a first cutting position and head or foot trimming of a second product 16 is carried out in a second cutting position at the same time. Within the cycle of the lifting movement of the cutter lifting assembly 2, the other components of the device 50 according to the invention must therefore transport the second product 16 out of the device 50 from the second cutting position, transport the first product 16 from the first cutting position into the second cutting position and bring a new product 16 into the first cutting position. For this, the transport system 9 has to bring the product as far as the front lays 15 and likewise ensure lateral alignment of the product before trimming. For this, the transport belts 7, 8 of the transport system 9 are also operated by the alignment configuration 30 during the lateral pushing movement, so that the product 16 is moved against the front lay 15 until it is fully aligned. If the machine cycle of the device 50 is then increased, this does not mean that all the other movements of the device are increased to the same extent. On the contrary, the transport period of the product 16 within the device 50 must not fall below a minimum transport duration as otherwise the gentle, safe transport of the product 16 cannot be ensured. In order for it nevertheless to be possible to operate the cutting configuration 50 at higher production speeds and thus with a shorter cycle, the time of the beginning of the pushing movement and also its duration can now be adapted in such a way thanks to the separate drive of the pushing movement and the associated alignment control 42 that the same amount of time remains for the transport of the product 16 within the cutting configuration 50.

The device has been described above in particular in connection with the three-sided trimming of unbound books, book blocks and brochures, which are produced in a gatherer-stitcher. It should be readily understood by those of skill in the pertinent art, however, that it is quite conceivable to use the device for three-sided trimming of other products as well. Moreover, it is conceivable to provide a corresponding device which performs only one or two trimming operations on a product, or correspondingly more than three, for instance in "trio cutting."

We claim:

1. A device for three-sided trimming of products, comprising:

a cutter lifting assembly configured to be operable in a lifting movement defining a machine cycle with a cycle duration;

a plurality of cutters, including cutters for head trimming, foot trimming, and front edge trimming of the products, mountable on said cutter lifting assembly, said cutter lifting assembly having a first cutting position and a second cutting position downstream of said first cutting position in a direction of travel of the products;

a transport system for transporting the products into said first cutting position, and from said first cutting position into said second cutting position within a transport period;

a lateral alignment configuration movable at least on one side in a direction perpendicular to said head trimming and said foot trimming cutters, for performing a pushing movement against the product, for bringing the product into a cutting position;

means for at least one of initiating and terminating the pushing movement of said alignment configuration to render at least one of a time of initiation of the pushing movement and a pushing duration of the pushing movement within the cycle duration substantially independent of the lifting movement of said cutter lifting assembly.

2. The device according to claim 1, wherein said means for at least one of initiating and terminating the pushing movement of said alignment configuration includes a separate drive.

3. The device according to claim 2, which further comprises a control device configured to activate said separate drive substantially independently of the lifting movement of said cutter lifting assembly.

4. The device according to claim 2, which further comprises a control device configured to activate said separate drive substantially independently of the lifting movement of said cutter lifting assembly, said control device determining the time of initiation and/or termination of the pushing movement of said alignment configuration such that the transport period of the product is substantially not increased when the cycle duration of the lifting movement of said cutter lifting assembly is shortened.

5. The device according to claim 1, which further comprises a front lay for the product disposed, at least intermittently, in a region of at least one said cutting positions of the device.

6. The device according to claim 1, wherein the pushing movement of said alignment configuration is timed to take place during the transport movement of said transport system.

7. The device according to claim 1, wherein said front edge trimming cutter is disposed at said first cutting position and said head trimming and foot trimming cutters are disposed at said second cutting position.

* * * * *